US005157360A

United States Patent [19]

McGann et al.

[11] Patent Number: 5,157,360

[45] Date of Patent: Oct. 20, 1992

[54] FREQUENCY SELECTIVE LIMITER WITH TEMPERATURE AND FREQUENCY COMPENSATION

[75] Inventors: William E. McGann, Linthicum; Thomas E. Steigerwald, Columbia, both of Md.

[73] Assignee: Westinghouse Electric Corp., Pittsburgh, Pa.

[21] Appl. No.: 711,847

[22] Filed: Jun. 7, 1991

[51] Int. Cl.[5] ..... H01P 1/218

[52] U.S. Cl. ..... 333/17.2; 333/24.2

[58] Field of Search ..... 333/1.1, 17.2, 24.1-24.3

[56] References Cited

U.S. PATENT DOCUMENTS 3,911,380 10/1975 Lavedan, Jr. ..... 333/24.1 X
3,946,340 3/1976 Simon ..... 333/24.1
4,845,439 7/1989 Stitzer et al. ..... 333/17.2

*Primary Examiner*—Paul Gensler

*Attorney, Agent, or Firm*—D. G. Maire

[57] ABSTRACT

The invention is directed to a frequency selective limiter. A ferrite member supports a signal carrying conductor and magnets establish a transverse magnetic field closely coupled with the conductor through the ferrite. The magnets establish a magnetic field strength versus temperature having a desired characteristic slope. A magnetic shunt, magnetically coupled to the magnets, diverts a portion of the magnetic field lines away from the ferrite for reducing the magnitude of the field coupled with the conductor to a lower value while maintaining the desired characteristic slope of the magnetic field strength with temperature. In a particular embodiment of the invention, the magnetic shunt establishes magnetic field lines within the ferrite which lie at a selected angle with respect to the conductor so that the limiting characteristic of the FSL is relatively flat across the bandwidth.

15 Claims, 4 Drawing Sheets

FREQUENCY SELECTIVE LIMITER WITH TEMPERATURE AND FREQUENCY COMPENSATION

BACKGROUND OF THE INVENTION

1. Field of the Invention

The invention relates to frequency selective limiters (FSLs) and in particular to FSLs having a temperature and frequency compensated magnetic bias field which results in improved performance over its bandwidth.

2. Description of the Prior Art

Presently manufactured frequency selective limiters 10 (FSLs), shown in FIG. 1, employ a YIG element 12 formed of a pair of single crystal YIG slabs 14 with a conductor 16 sandwiched therebetween. An exemplary YIG structure has a 111 lattice that has been grown in a liquid epitaxy furnace on a GGG substrate 18. The magnetic resonant line width of YIG is about 1 oerstead or less. A static bias field H is applied in the plane of the conductor an angle of 90° thereto.

The static magnetic field H is provided by a pair of opposed permanent magnets 20 placed on either side of the YIG element 12. Typically, the strength of the field produced by the magnets 20 decreases with increasing temperature. The strength of the magnetic field H required to achieve a particular performance level at various temperatures within a given temperature range of interest may be quite different from the field actually produced by the magnet 20. Indeed, there may be only one or two values where the required field H for the particular temperature is correct. As a result, the performance of the YIG element 12 may degrade with changing temperature.

FSLs are typically employed in a bandwidth from about 2.5 to about 5.5 GHz. In this bandwidth, it is normally desirable to develop flat limiting characteristic between the two frequencies (see FIG. 2). Typically, however, limiting rolls off at the lower frequencies. As the field strength is increased however, the characteristic roll-off moves to the left in FIG. 2 so that limiting is generally flat over the bandwidth. If the magnetic field strength is increased beyond the certain limit, the low frequency roll-off tends to move to the right as a result of volume wave propagation. Thus, there is only a small range of field values which results in advantageous limiting.

The limiting illustrated in FIG. 2 results at a specific temperature and magnetic field strength. Accordingly, as the temperature changes, the magnetic field strength changes causing a variation in the limiting characteristic.

In FIG. 3 curve A illustrates the ideal relationship of magnetic field strength versus temperature for a YIG element. In addition, the tolerance around the ideal is illustrated in dotted line. The curve shows that over a given exemplary temperature range from about −50° C. to about 85° C. the required field strength decreases with increasing temperature.

The curves B-E of magnetic field strength versus temperature, for various charging levels, of a typical permanent magnet are also shown in FIG. 3. The actual slope of each curve B-E is dependent upon a number of factors, but is primarily dependent on the initial magnetization or charge of the magnet. For example, a magnet with a low charge produces a curve B exhibiting low field strength which is much shallower than the ideal A. As the charge on the magnet is increased, the strength of the field produced by the magnet increases absolutely over the temperature range and the slope of the curve increases until it reaches the slope of the ideal (curve C), more highly charged magnets exhibit a steeper slope (curves D-E). Unfortunately, as the charge is increased, the field strength increases to such a level that the limiting characteristic is degraded, i.e. moved to the right in FIG. 2 thereby degrading the performance of the FSL. Also, no means has been formed to tailor the curve to all temperatures.

It has also been found that the low frequency roll-off of the attenuation curve in FIG. 2 can be advantageously affected by rotating the biasing field by a small amount a set forth in copending patent application Ser. No. 658,498, filed Feb. 21, 1991 entitled "Frequency Selective Limiter With Flat Limiting Response" by McGann et al. and assigned to Westinghouse Electric Corporation the assignee herein, the teachings of which are incorporated hereby reference. In that arrangement, the field is rotated with respect to the conductor by physically orienting the YIG and conductor carried thereby at an angle with respect to the field or by providing a zigzag conductor on the YIG film. While effective, the solutions set forth in the application create volume efficiency reductions and manufacturing difficulties which need improvement.

SUMMARY OF THE INVENTION

The invention is directed to an improved FSL in which performance over a desired temperature range is improved. Further the FSL has a relative flat low frequency limiting response.

In a particular embodiment, the invention is directed to a frequency selective limiter for selectively attenuating signals within a bandwidth above a threshold and for allowing signals below the threshold to pass without significant attenuation. The FSL comprises a pair of planar ferrite members having planar surfaces in confronting relationship and at least one signal carrying conductor supported between the ferrites and being closely coupled thereto. Magnet means is provided for establishing a magnetic field. The magnetic field has lines which are closely coupled with the conductor through the ferrite and which extend transverse of the conductor. The magnet means establishes a magnetic field strength versus temperature having a desired characteristic slope. Shunt means magnetically coupled to the magnetic means diverts a portion of the magnetic field lines away from the ferrite for reducing the magnitude of the field coupled with the conductor to a lower value while maintaining the desired characteristic slope of the magnetic field strength with temperature.

In a particular embodiment of the invention, the shunt means establishes magnetic field lines within the ferrite which lie at a selected angle with respect to the conductor so that the limiting characteristic of the FSL is relatively flat across the bandwidth.

In a particular embodiment the magnetic means is a permanent magnet charged to a value in excess of that which is necessary to achieve the desired limiting characteristic over the bandwidth but having a slope parallel to an ideal magnetic field strength required by the ferrite over said temperature range. The shunt means reduces the magnitude of the field produced by the magnet which is coupled to the ferrite so that the temperature versus field strength characteristic is generally collinear with the required field strength characteristic over the temperature range.

The shunt means comprises at least one soft iron or cold rolled steel bar being magnetically coupled to the magnet means and spaced adjacent the ferrite for diverting some of the magnetic field away from the ferrite. In a particular embodiment of the invention, a plurality of iron bars are provided in interdigitated relationship on opposite sides of the ferrite for causing the magnetic lines to lie at a selected angle with respect to the conductor whereby the limiting is relatively flat across the bandwidth.

DESCRIPTION OF THE PREFERRED EMBODIMENT

Figure 1:
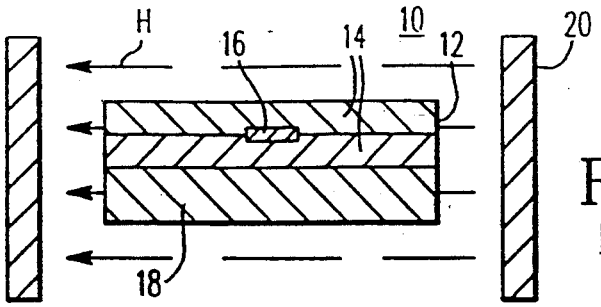
FIG. 1 PRIOR ART
FIG. 1 is an end section of a known FSL according to the prior art.
Figure 2:
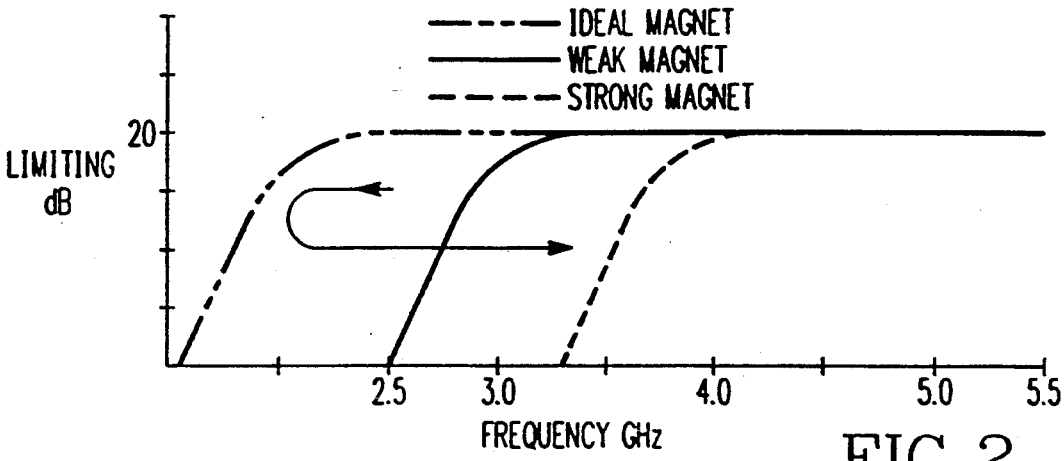
FIG. 2 are limiting curves for an FSL over a range of frequencies with different values of field strength applied to the FSL.

Referring to FIGS. 4–9 there is illustrate 40 in accordance with the present invention. The FSL 40 includes a YIG element 42 which is formed of a pair of planar YIG elements 44 and 45 having confronting planar surfaces 46 and 47 and lateral marginal edges 48 and 49. A conductor 50 is disposed between the confronting YIG elements 44 and 45 and lies generally along a central axis 52 of the FSL 40. The lower YIG layer 45 is formed atop a GGG substrate 54. The upper and lower YIG elements 44 and 45 may be bonded together by a variety of techniques including a technique set forth in U.S. patent application Ser. No. 656,340, filed Feb. 19, 1991 entitled "Frequency Selective Limiter With Welded Connectors" by McGann et al., assigned to Westinghouse Electric Corporation the assignee herein the teachings of which are incorporated herein reference.

A pair of magnets 60 and 62 are disposed along opposite sides 48 and 49 of the YIG element 42 as illustrated. The magnets 60 and 62 produce a magnetic field H which is generally transverse to the conductor 50 and lies in the plane of the YIG element 42. Each magnet 60 and 62 is charged or magnetized such that it exhibits a desired field versus temperature characteristic which is parallel to the desired or ideal field versus temperature characteristic for the YIG element 42.

Figure 3:
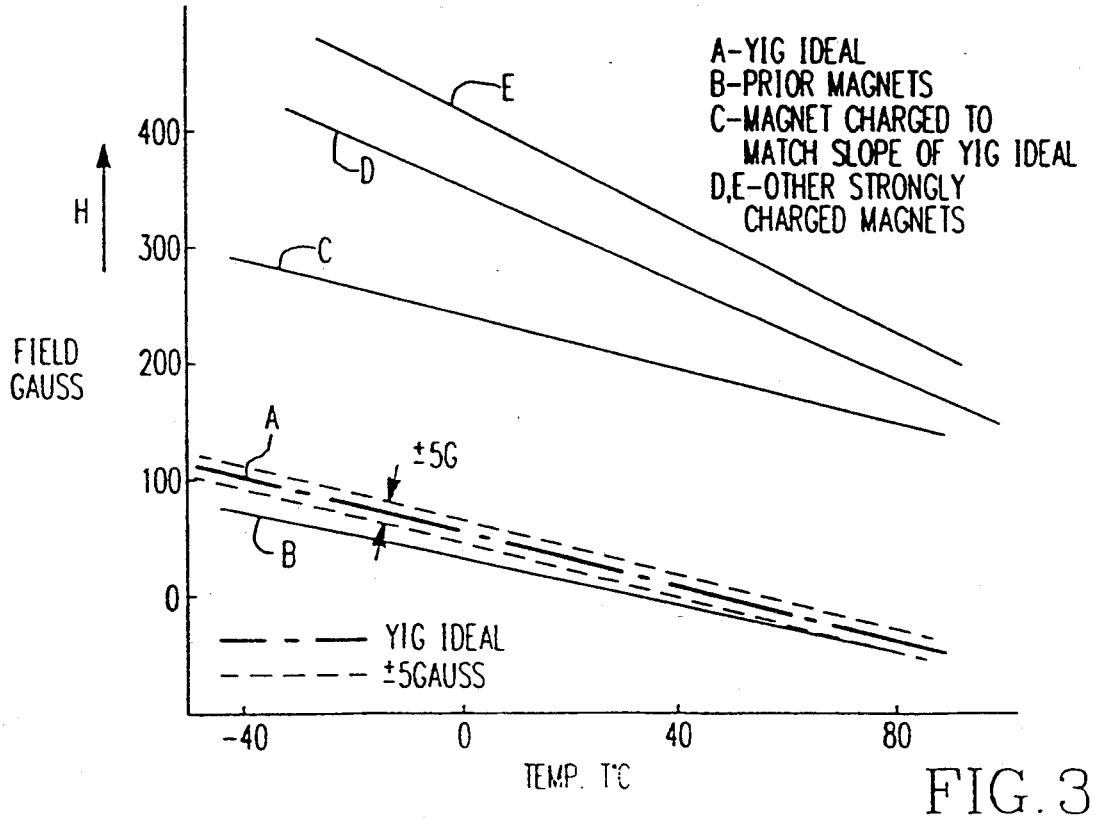
FIG. 3 illustrates various field versus temperature curves for magnets charged to different levels compared with an ideal field versus temperature curve for the YIG element.
Figure 4:
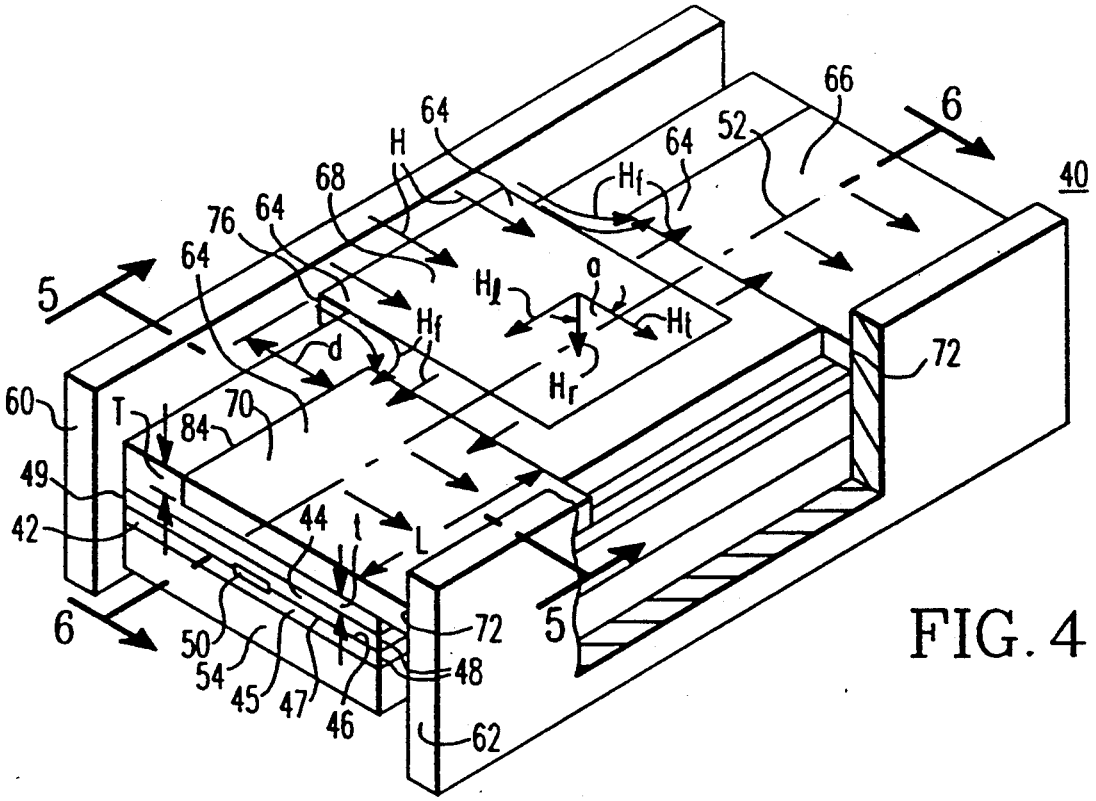
FIG. 4 is a partially fragmented perspective view of an FSL according to the present invention.
Figure 5:
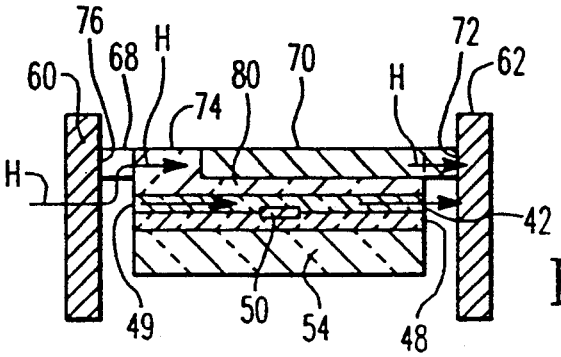
FIG. 5 is a sectional view of the FSL taken along line 5—5 of FIG. 4.
Figure 6:
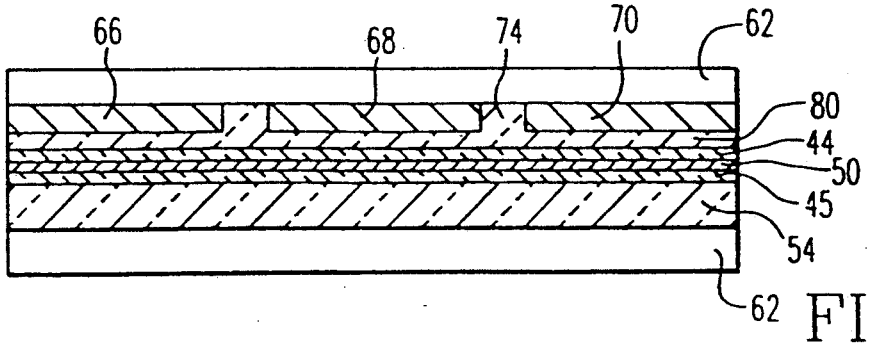
FIG. 6 is a sectional view of the FSL taken along line 6—6 of FIG. 4.
Figure 7:
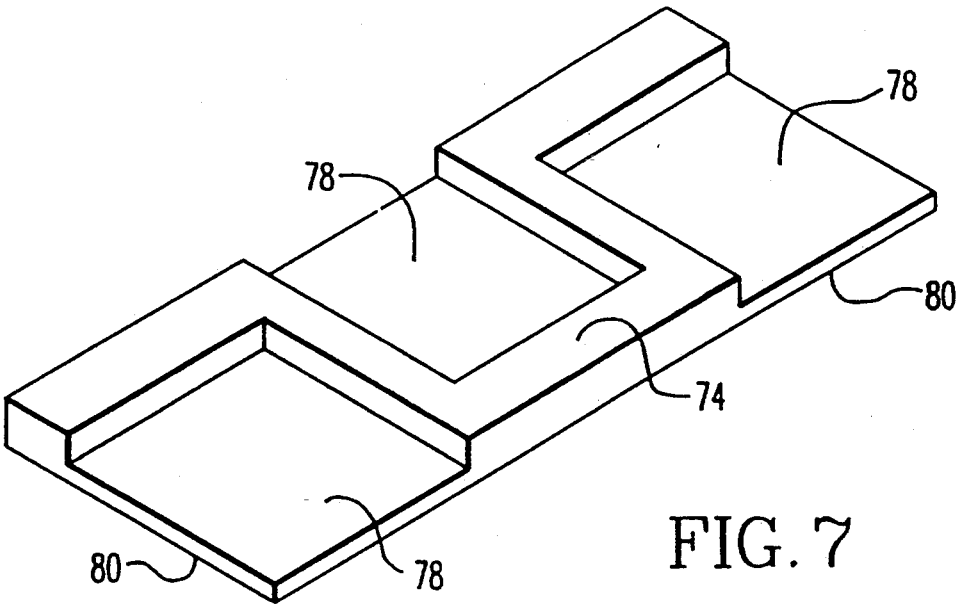
FIG. 7 is a perspective view of a shim which supports a plurality of magnetic shunts employed in the present invention.
Figure 8:
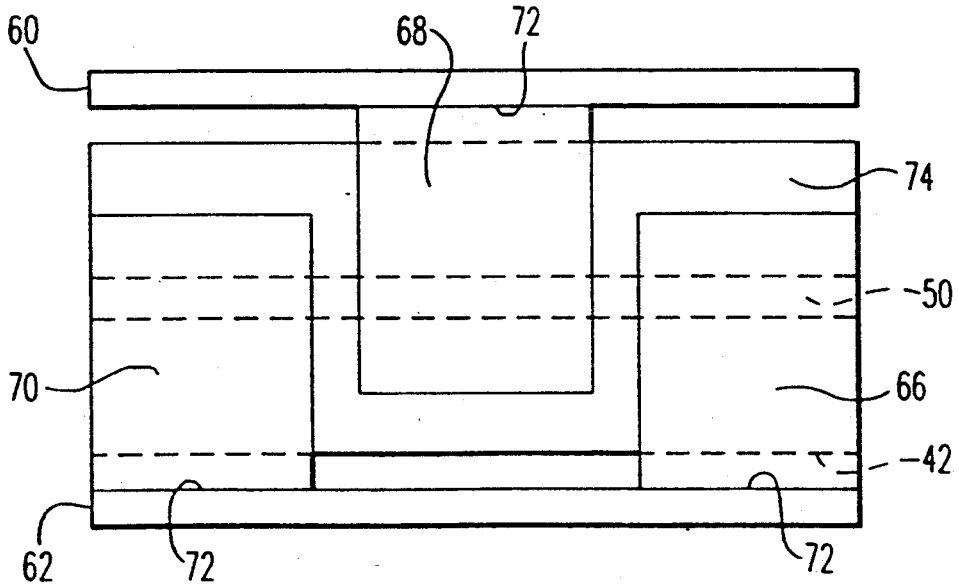
FIG. 8 is a top plan view of the FSL shown in FIG. 4.
Figure 9:
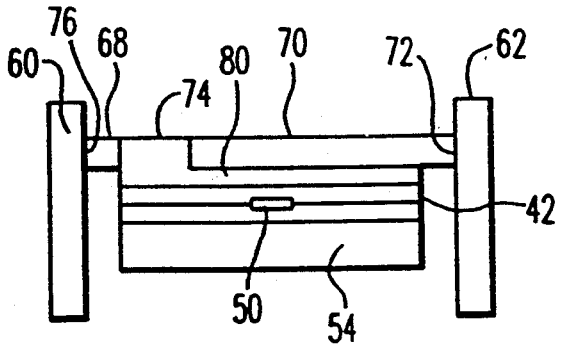
FIG. 9 is an end view of the FSL shown in FIG. 4.

Referring to FIG. 3, for example the YIG element 42 has an ideal characteristic A +/−5 gauss. An impressed magnetic field exhibiting a characteristic which is close to the ideal A is desired. Curve C is the field versus temperature characteristic of a highly magnetized magnet which is essentially parallel to the YIG ideal A. In accordance with the invention, a portion of the magnetic field is diverted such that the field intensity coupled to the YIG element 42 is reduced so that it is essentially collinear with the YIG ideal A or at least within the tolerances set forth across the temperature range. In order to achieve the desired resulting field, the magnets 60 and 62 are charged sc that they exhibit a field versus temperature characteristic which is parallel with the YIG element 42. Magnetic shunting means 64, magnetically coupled with the magnets 60 and 62, divert a portion of the magnetic field H away from the YIG element 42. In the embodiment illustrated the magnetic shunting means 64 includes a plurality of interdigitated soft iron bars 66, 68 and 70. The iron bars 68 and 70 are closely coupled with the magnet 62 at outboard ends 72 and are supported atop the YIG element 42 by means of a nonmagnetic shim 74. Likewise, the iron bar 68 is closely coupled with the magnet 60 at its outboard end 76 and it too is supported on the YIG element by means of a nonmagnetic supporting element 74. The supporting element 74 has pockets 78 which receive the magnetic means 64. See for example FIG. 7. Each of the pockets 78 is formed as a recess in the support member 74. Each bar 66, 68 and 70 of the magnetic shunting means 64 is separated from the YIG element 42 by means of a reduced thickness shim 80 integral with the support member 74.

As can be appreciated from an inspection of FIGS. 4–9, the field H is directed around the YIG element 42 thereby reducing the effective field strength therethrough, such that it matches the ideal or desired characteristic A as exemplified in FIG. 3. In addition, the interdigitated configuration of the iron bars 66, 68 and 70 cause the field H to be distorted having transverse components $H_t$ perpendicular to the conductor 50 and longitudinal components $H_l$ parallel with the conductor 50. The field H is distorted as a result of the interdigitated iron bars 66, 68 and 70 because the bars cause lateral fringing of the field as illustrated by the arrows $H_f$ which couple the field H longitudinally of the axis 52. Accordingly, there is produced a resulting magnetic field $H_r$, which lies at an angle (a) with respect to the transverse component of the applied magnetic field H and in the plane of the YIG element 42. The angle (a) may be about 10°–20°. In a preferred embodiment, the angle (a) is about 13° and achieves a desired overall improved flat limiting response across the bandwidth of interest.

Figure 10:
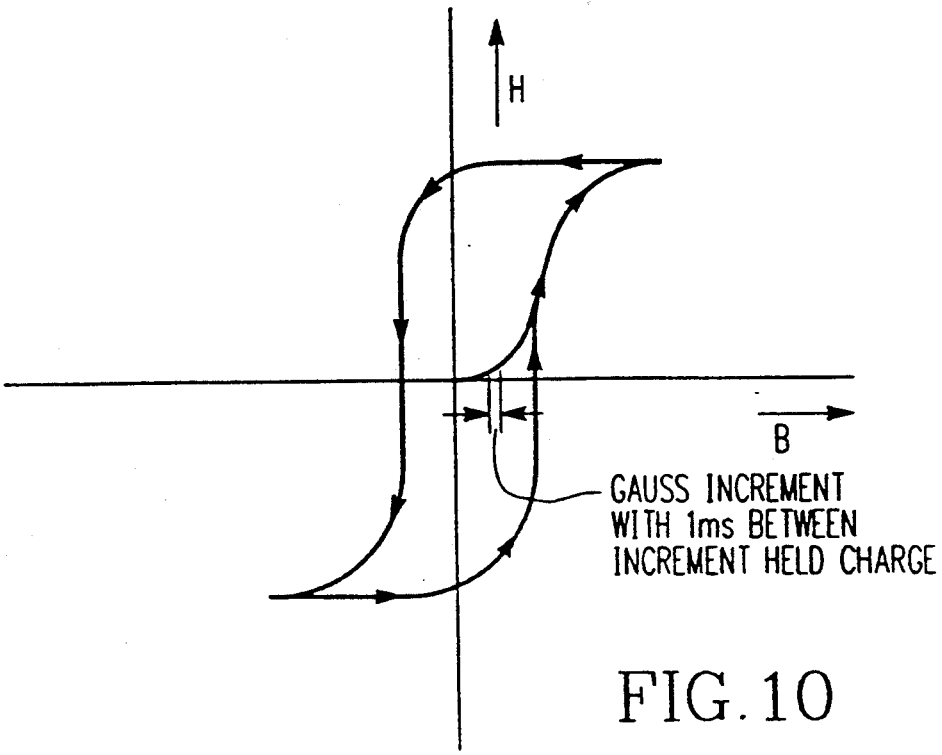
FIG. 10 is a B-H curve of a typical magnet employed in FSLs according to the present invention.

In order to properly achieve the proper charge or magnetization of the magnets 60 and 62, it is necessary to place them in a magnetizing or applied field B. For example, in FIG. 10 the applied magnetic field B results in a residual magnetic field H in the magnet in accordance with the well known B-H curve illustrated. If however, a large magnetic field B is applied instantaneously, large magnetic domains are produced resulting in strong residual stresses in the magnets 60 and 62. Accordingly, the magnets 60 and 62 are charged to a desired value by incrementally increasing the applied field B in small steps using a pulse magnetizer/demagnetizer. A time delay or pause, i.e. 1 ms, between each increase allows self annealing of the domain walls. The magnets are thus virtually unstressed as they are charged to the desired level. As a result, the field H produced by the magnet does not degrade with time and as the temperature changes. In other words, the magnets 60 and 62 are self annealed.

In order to tailor the magnitude of the resulting field, the length L, thickness T and distance d from the free end 84 of the magnets 66, 68 and 70 may be adjusted. Likewise, the thickness T of the shim 80 may be tailored to provide the proper field. Typically, the support member 74 is nonmagnetic material such as aluminum. A preferred magnet material is e.g. Ba and Co alloy. The magnetic properties are established by the magnet alloy and cold rolled steel or soft iron of the shunt means 64.

While there has been described what at present are believed to be the preferred embodiment of the present invention, it will be apparent to those skilled in the art the various changes and notifications may be made therein without departing from the invention, and are intended in the appended claims to cover all such modifications and changes that come within true spirit and scope of the invention.

What is claimed is:

1. A frequency selective limiter for selectively attenuating signals within a bandwidth above a threshold and allowing signals below the threshold to pass without significant attenuation comprising:

a pair of ferrite members having planar surfaces in confronting relationship;

at least one signal carrying conductor supported between said ferrite members and being closely coupled thereto;

magnet means for establishing a magnetic field having a selected magnitude closely coupled with the conductor through the ferrite members and having magnetic field lines extending transverse of the conductor, said magnet means exhibiting a magnetic field strength versus temperature having a desired characteristics slope; and shunt means for reducing the magnitude of the magnetic field coupled with the conductor to a lower value while maintaining the desired characteristic slope of the magnetic field strength with temperature.

2. The frequency selective limiter of claim 1 wherein the shunt means includes at least one iron member magnetically coupled to the magnet means and is disposed adjacent the ferrite members for diverting a portion of the field away from the ferrite members.

3. The frequency selective limiter of claim 1 wherein the shunt means includes means for directing the magnetic field lines at an angle with respect to the conductor.

4. The frequency selective limiter of claim 3 wherein the field lines are in a plane parallel to the plane of the ferrite members.

5. The frequency selective limiter of claim 3 wherein the angle is between about 10° and 20°.

6. The frequency selective limiter of claim 5 wherein the angle is about 13°.

7. The frequency selective limiter of claim 1 wherein the shunt means includes a plurality of interdigitated axially spaced apart iron members magnetically coupled to the magnet means on opposite marginal edges of the ferrite members lengthwise of the conductor for directing the magnetic field lines at an angle with respect to the conductor.

8. The frequency selective limiter of claim 7 further including support means having pocket portions for receiving the respective interdigitated iron bars.

9. The frequency selective limiter of claim 1 further comprising shim means for spacing the shunt means from the ferrite members.

10. The frequency selective limiter of claim 9 wherein the shim means comprises a nonmagnetic metal.

11. The frequency selective limiter of claim 1 wherein the magnetic field lines are in a plane transverse to the ferrite members.

12. The frequency selective limiter of claim 1 wherein the magnet means comprises a pair of Ba and Co alloy magnets having spaced apart confronting faces and the shunt means comprises at least one bar coupled to at least one of the magnets and spaced from the ferrite members; wherein said bar is a material selected from the group of cold rolled steel and soft iron.

13. A frequency selective limiter comprising:

at least one signal carrying conductor; a ferrite member in closely coupled relationship with the conductor; biasing means for establishing a biasing magnetic field with respect to the conductor and the ferrite member wherein magnetic field lines produced by the biasing means lie at an acute angle with respect to the conductor such that the limiter has increased attenuation at lower frequencies and thereby results a relatively flat limiting characteristic across its bandwidth, said biasing means having a magnetic field strength versus temperature curve which is greater than but generally parallel to an ideal magnetic field strength versus temperature curve for the ferrite member; means for reducing the magnetic filed coupled to the ferrite member without significantly changing the slope of the field strength versus temperature curve, thereby producing a resulting field which is generally colinear with said ideal curve.

14. A frequency selective limiter for selectively limiting incoming signals above a threshold comprising a ferrite member having a planar surface and parallel marginal edges, said ferrite member having a desired limiting response to incoming signals which is obtained along an ideal magnetic field versus temperature function, said function having a characteristic slope;

at least one conductor located on a central axis of the ferrite member and parallel with the marginal edges;

magnet means for producing magnetic field lines transverse of the central axis and parallel to the planar surface, said magnet means having a charge producing a field versus temperature characteristic parallel to the slope of said ideal function;

shunt means for reducing the field coupled with the ferrite member so that the magnetic field is generally collinear with the ideal function in an operating range of temperatures.

15. The frequency selective limiter of claim 14 wherein the field lines lie at an angle with respect to the conductor in the plane of the ferrite member.

* * * * *